United States Patent [19]

Hawke et al.

[11] 4,343,223

[45] Aug. 10, 1982

[54] MULTIPLE STAGE RAILGUN

[75] Inventors: Ronald S. Hawke, Livermore; Jonathan K. Scudder, Pleasanton; Kristian Aaland, Livermore, all of Calif.

[73] Assignee: The United States of America as represented by the United States Department of Energy, Washington, D.C.

[21] Appl. No.: 153,365

[22] Filed: May 23, 1980

[51] Int. Cl.[3] ..... F41F 1/00; F41F 1/02; F41F 7/00

[52] U.S. Cl. ..... 89/8; 376/100; 124/3

[58] Field of Search ..... 89/8; 124/3; 310/12; 73/12; 376/100

[56] References Cited

U.S. PATENT DOCUMENTS

| | | | |
|---|---|---|---|
| 2,783,684 | 3/1957 | Yoler | 89/8 |
| 2,790,354 | 4/1957 | Yoler et al. | 89/8 |
| 3,279,320 | 10/1966 | Rosebrock | 89/8 |
| 3,417,273 | 12/1968 | Gates et al. | 89/8 |
| 3,613,499 | 10/1971 | Hubbard et al. | 89/8 |
| 4,010,396 | 3/1977 | Ress et al. | 176/1 |

OTHER PUBLICATIONS

UCRL-82677, (5/25/79) Hawke et al.
UCRL-82762, (7/10/79) Hawke.
UCRL-52778, (7/6/79) Hawke.
UCRL-82296, (10/2/79) Hawke et al.
Accel. Macropart. & Hypervel. EM Accelerator, Barber (3/72) Australian National Univ., Canberra ACT pp. 71, 90-93.
LA-8000-G (8/79) pp. 128, 135-137, 140, 144, 145 (Marshall pp. 156-161 (Muller et al).

*Primary Examiner*—Sal Cangialosi
*Attorney, Agent, or Firm*—L. E. Carnahan; Roger S. Gaither; Richard G. Besha

[57] ABSTRACT

A multiple stage magnetic railgun accelerator (10) for accelerating a projectile (15) by movement of a plasma arc (13) along the rails (11,12). The railgun (10) is divided into a plurality of successive rail stages (10*a–n*) which are sequentially energized by separate energy sources (14*a–n*) as the projectile (15) moves through the bore (17) of the railgun (10). Propagation of energy from an energized rail stage back towards the breech end (29) of the railgun (10) can be prevented by connection of the energy sources (14*a–n*) to the rails (11,12) through isolation diodes (34*a–n*). Propagation of energy from an energized rail stage back towards the breech end of the railgun can also be prevented by dividing the rails (11,12) into electrically isolated rail sections (11*a–n*, 12*a–n*). In such case means (55*a–n*) are used to extinguish the arc at the end of each energized stage and a fuse (31) or laser device (61) is used to initiate a new plasma arc in the next energized rail stage.

9 Claims, 13 Drawing Figures

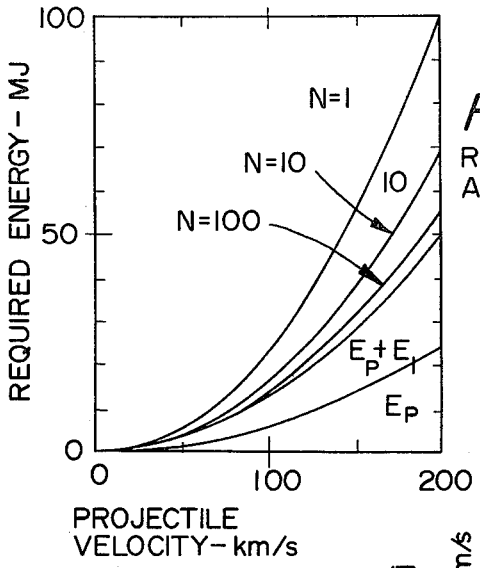
FIG. 11
REQUIRED ENERGY FOR 1-, 10-, AND 100-STAGE RAILGUNS
FIG. 12
100-STAGE ACCELERATOR WITH EQUAL-LENGTH STAGES
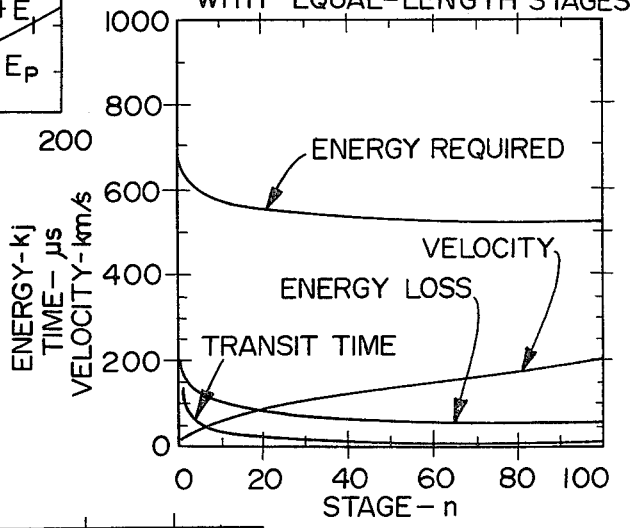
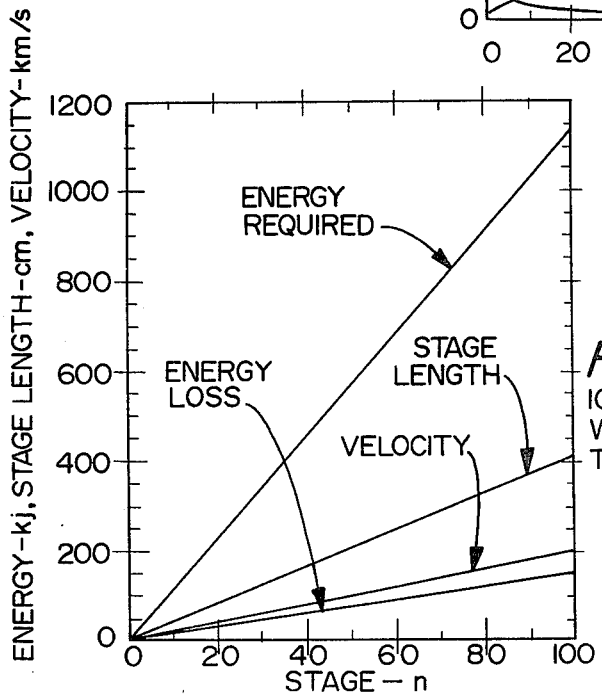
FIG. 13
100-STAGE ACCELERATOR WITH EQUAL TRANSIT-TIME STAGES

MULTIPLE STAGE RAILGUN

The invention described herein arose at the Lawrence Livermore Laboratory under, or in the course of, Contract No. W-7404-ENG-48 between the United States Department of Energy and the University of California.

TECHNICAL FIELD

This invention relates to magnetic railgun accelerators.

BACKGROUND ART

The promise of abundant energy has inspired many approaches to controlled thermonuclear fusion. Pellets, ignited one per second, could be the energy source for power plants producing billions of watts of electrical power. To achieve ignition, one would have to deliver about 1 megajoule (MJ) of energy to a deuterium-tritium (DT) pellet in about 10 nanoseconds (ns). Candidate igniters have included laser, electron, and heavy- and light-ion beams.

Another approach would be to ignite a DT pellet with the impact of a projectile weighing about 0.1 gram. Such a projectile could be accelerated to hyperveloicty (150 km/s or more) by a magnetic accelerator. The advantage of the use of a projectile is that the energy would be concentrated into a small volume. If the projectile moves rapidly enough to contain the energy, then it would be easy to deliver the energy in the required 10 ns by making the projectile short enough.

The present invention relates to an electromagnetic railgun as a projectile launch device.

In order to better understand the present invention, the operating principles and limitations of a prior art electromagnetic railgun system, as exemplified in FIGS. 1–3, should first be considered.

A railgun accelerator 10, as shown in FIG. 1, is a linear dc motor consisting of a pair of rigid, electrically- and field-conducting rails 11 and 12 and a movable conducting armature 13. Basically, the armature 13 is accelerated along the rails as a result of the Lorentz force produced by the current, I, from a primary energy-storage device (PESD) 14, in the armature 13 interacting with the magnetic field B produced by the current in the rails 11 and 12. The armature 13 acts upon the rear of projectile 15 to accelerate it down the rails 11 and 12.

Preferably, a plasma arc is used as the armature 13, the arc being produced between the rails by the PESD 14. Typically, a rail gun assembly may be as shown in FIG. 2, with a dielectric 16 serving to maintain the rail position, to form with rails 11 and 12 the bore 17 of the railgun, and to confine the plasma arc armature 13 behind the projectile 15. A jacket 18, of steel for example, serves as the supporting barrel of the railgun.

A typical rail gun system, as shown in FIG. 3, functions as follows. A PESD 14, such as a capacitor bank or homopolar generator, is used to generate a current in the storage inductor 21 after switch 22 is closed. When the desired, usually maximum, current is established in inductor 21, switch 24 is closed to isolate the PESD 14 from the circuit. At this time, and if the PESD 14 is a homopolar generator, shuttle switch 26, such as a sliding multifingered conductor initially bridging between the two busbars 27 and 28, is moved across the breech end 29 of the railgun 10 to bridge between busbars 28 and 30. Rails 11 and 12 are electrically connected to busbars 28 and 30, respectively. As the shuttle switch 26 moves across the breech end of the rail gun, out of contact with busbar 28 and into contact with busbar 29, fusible wire 31, connected between the rails 11 and 12 will initially conduct current but will quickly vaporize and establish the plasma arc. (If the PESD is a capacitor bank, busbars 27 and 30 are shorted together and shuttle switch 26 is not needed).

The plasma arc 13 and projectile 15 will then accelerate along the rails 11 and 12. Prior to the arc exiting the discharge end 32 of the railgun, crowbar switch 33 is closed to extinguish the plasma arc and avoid spurious arcing.

The use of a plasma arc as an armature 13 for accelerating the projectile has several advantages over a sliding metallic conductor. First, the plasma arc easily maintains contact with the rails. Secondly, a conducting metallic armature resistively melts. Thirdly, a sliding metal contact experiences a large erosive drag force.

Acceleration, a, of the projectile 15 is given by $$a = \int_0^w \frac{\bar{I}\, d\bar{w} \times \bar{B}}{m} = \frac{L_1 I^2}{2m},$$

where I is the current in the arc, w is the rail spacing, B is the magnetic-field intensity in the region of the arc, m is the mass of the projectile, and $L_1$ is the inductance per unit length of the rail gun.

The projectile velocity, v, is given by $$v = \int a dt$$

wherein t is time, and the projectile position z, is given by $$z = \int v dt.$$

At high current density, the plasma-arc voltage, $V_A$, is nearly independent of the arc current and is equal to about 200 v.

The voltage, $V_I$, resulting from the time variation of the current and inductance, L, of the railgun, is given by $$V_I = \frac{d(LI)}{dt} = L\frac{dI}{dt} + I\frac{dL}{dt}$$

Since $L = L_1 z$, then $(dL/dt) = L_1 v$.

The voltage, $V_R$, along the two rails is given by $$V_R = 2\int_0^z IR dz$$

where R is the resistance of each rail.

Using Kirchhoff's law, $$IR_o + L_o\frac{dI}{dt} + IR + I\frac{dL}{dt} + L\frac{dI}{dt} + V_A = 0,$$

from which the current and voltages are calculated. (Stray circuit resistance and inductance are included in $R_o$ and $L_o$ of resistance 23 and inductance 21, respectively.

The following equation may be used to calculate the distribution of energy throughout the projectile's acceleration. The instananeous energy, $E_c$, in the storage coil 21 is $$E_c = \frac{L_o I^2}{2}$$

The inductive energy, $E_I$, between the rails is $$E_I = \frac{Z L_I I^2}{2}$$

The energy loss, $E_A$, in the plasma arc is $$E_A = \int V_A I dt.$$

The energy loss, $E_R$, in the fixed elements and rails is given by $$E_R = \int I^2 R_o \, dt + 2 \int I^2 R dt$$

The instantaneous kinetic energy, $E_p$, of the projectile is $$E_p = (mv^2/2)$$

Single-stage railguns as described above have been used to accelerate projectiles to velocities of up to 10 km/s. Higher velocities are obtainable, but the design and operation of a railgun is restricted by several practical considerations.

In order to prevent rail melting, or undue loss of rail strength from high temperature, the perimeter current density for a copper rail system initially at room temperature might be limited to 43 kA/mm for a single launch. If the system is initially at liquid nitrogen temperature, the perimeter current density might be limited to 75 kA/mm.

The magnetic pressure on the rails is a function of the current per mm of rail spacing. If a hardened steel rail is used for strength, with copper plating for electrical efficiency, then in order for the magnetic pressure forces to remain below the yield point of hardened steel with a typical elastic strength of 0.7 GPa ($10^5$ psi), the current must remain less than 75 kA/mm of rail spacing.

In order to protect against destructive acceleration and maintain the mechanical integrity of a square-bore projectile having a typical elastic strength of 1.4 GPa ($2 \times 10^5$ psi), the current must remain less than 81 kA/mm of rail spacing.

Because launch performance improves with current and because current per unit spacing and current per unit perimeters have limits as set forth above, it is desirable to maximize rail spacing and rail perimeters. The perimeter can be increased indefinitely on the outside portion of the rails, but the rail spacing governs the bore size (assumed to be square). The aspect ratio, $A_R$, defined as the ratio of the length to the height and width of the projectile must remain greater than 0.5 to maintain dynamic stability. Hence, increasing the bore results in a longer, larger, and more massive projectile, which in turn requires more input energy and a longer accelerator. Accordingly, the choice of bore size is a compromise between competing factors that vary with a specific application.

A spurious arc discharge between the rails, other than the arc driving the projectile, will divert some or all of the remaining energy delivered to the rails. The inductive voltage appears across the rails immediately behind the driving arc. The resistive voltage occurs along the rails from the arc toward the breech of the railgun where the total voltage appears. The breakdown voltage is a function of rail spacing and magnetic field strength, and thus establishes the smallest bore that can be used without spurious arc.

In addition to the above considerations, the performance of a railgun launch is limited by the amount of energy available to it. Maximum available energy loss incurred in transfers from the PESD to the storage inductor and then to the railgun.

Based upon the above considerations a railgun accelerator system as shown in FIGS. 1–3 can be designed to accelerate a 0.1 payload to a velocity of 150 km/s. The projectile 15 comprises a sabot, or carrier, in which the payload is mounted to permit its launching and the payload. The sabot is typically a graphite composite.

As brought out above, a higher current leads to a shorter accelerator and lower energy loss. The limit on current per unit rail spacing (75 kA/mm) requires a larger bore for higher current. However, as the bore increases, the mass of the sabot increases, requiring more energy for its launching. As a consequence, even though a larger bore permits higher current and hence acceleration force, a small bore is superior because of the smaller sabot mass and resulting higher velocity. The breakdown voltage establishes in the presently described system, a 6.7 mm bore as the smallest that can be used. To provide a safety margin, the minimum rail spacing can be about 10 mm.

Accordingly, the rails 11 and 12 should have a height of 10 mm and be spaced 10 mm apart to provide a square bore. To prevent rail melting, the rails should have a 40 mm perimeter. A square bore of 10 mm per side will require the sabot to have a length of 5 mm and consequent mass of 1.13 g. With a 0.1 g payload, the projectile mass will thus be 1.23 g.

To achieve a launch velocity of 150 km/s, and with a current limit of 750 kA, a minimum of 52 MJ of initial energy in the storage inductor 21 would be required. Since PESD energy must be greater by the amount lost in charging the storage indicator, and with expectable 85% efficiency, the PESD energy would be about 60 MJ.

If there is enough stored energy to maintain a constant maximum current of 750 kA throughout acceleration, a railgun length of at least 115 m is required to achieve the desired velocity. When the stored energy is not adequate to maintain constant maximum current, the length of the accelerator must be increased.

The efficiency of converting the initial energy stored in the inductor into kinetic energy of the payload can be 2% at 150 km/s. If the kinetic energy of the sabot mass could also be used as a payload, the efficiency would be about 25%. The efficiency will vary somewhat depending upon whether the recoverable inductive energy in the railgun is recovered for use in the next launch or not.

Although a railgun system as described above can obtain the desired launching speed of the payload, it has several significant disadvantages. Approximately half of the energy stored in the inductor is lost in resistive heating of the rails. A very large capacity PESD would be required to furnish the energy without current decay. Current decay would require a longer railgun, which, in turn, would increase the resistive losses and reduce efficiency.

The present invention is directed to overcoming one or more of the problems as set forth above.

SUMMARY OF THE INVENTION

In one aspect of the invention, this is accomplished by dividing the railgun accelerator into a plurality of relatively short successive stages which are separately and sequentially energized to accelerate a projectile along the length of the railgun.

A further aspect of the invention is that energy from an energized stage is prevented from propagating back to preceding stages.

The foregoing and other aspects will become apparent from the following detailed description of the invention when considered in conjunction with the accompanying drawings.

BRIEF DESCRIPTION OF THE DRAWINGS

FIGS. 9–13 are graphs illustrating performance of multi-stage railgun accelerators.

BEST MODES FOR CARRYING OUT THE INVENTION

The basic concept of the present invention, common to each of the various forms of the invention shown in FIGS. 4–8, is that the two rails of a magnetic railgun are divided into a plurality of relatively short stages which are separately and sequentially energized as the projectile moves down the length of the railgun. Such division and sequential energization: greatly reduces the energy loss in heating the rails; allows relatively small energy sources to be used to deliver the required energy to the projectile; allows current to be more easily maintained at the maximum usable value in each stage; and, reduces the resistive voltage drop. In order to operate successfully, the maximum amount of the energy supplied to each stage is to be used for acceleration of the projectiles and such energy is not to be allowed to propagate back toward the breech.

Figure 1:
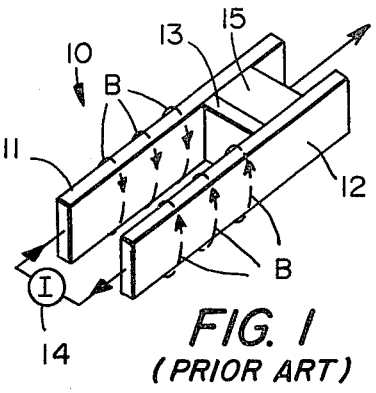
FIG. 1 (PRIOR ART)
FIG. 1 is a simplified perspective view of the basic element of a magnetic railgun accelerator.
Figure 2:
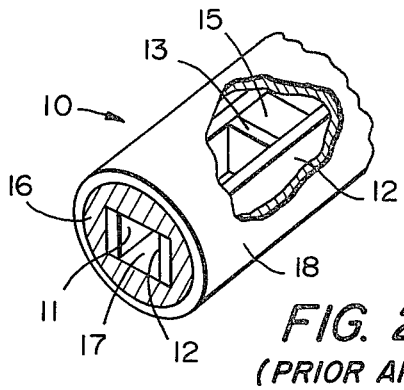
FIG. 2 (PRIOR ART)
FIG. 2 is a perspective view, with portions cut away, of a section of a basic railgun assembly.
Figure 3:
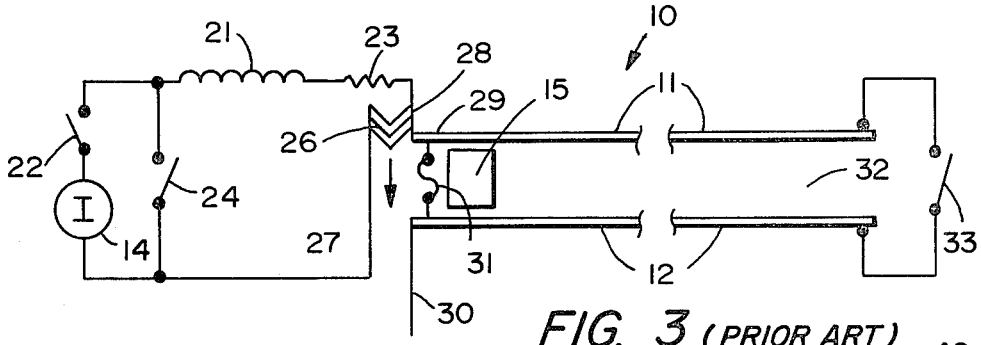
FIG. 3 (PRIOR ART)
FIG. 3 is a generally diagrammatic illustration of a single-stage railgun system using a homopolar-storage indicator.
Figure 4:
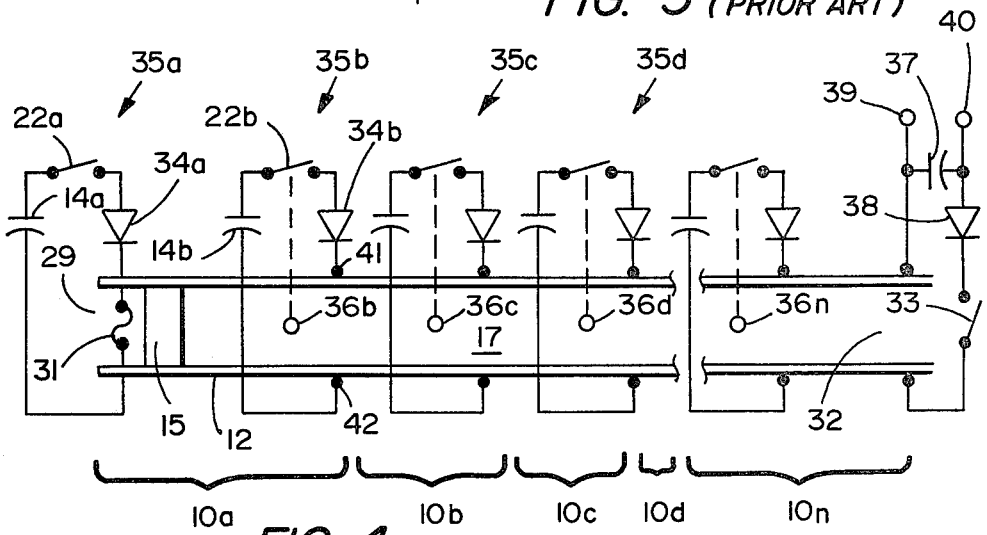
FIG. 4 is a view, similar to FIG. 3 of a multi-stage railgun system in accordance with the present invention, using a capacitor bank as a PESD and using diode isolation of the various stages.

In the multi-stage railgun system shown in FIG. 4, rails 11 and 12 are each integral throughout their length, as in FIG. 3. The launch can be initiated by closure of switch 22*a*, so that the PESD 14*a* (shown herein as a capacitor bank) will discharge through isolation diode 34*a* and cause fuse 31 to vaporize and initiate a plasma arc behind projectile 15. The elements just described constitute a means 35*a* for energizing the first section 10*a* of the railgun 10.

PESD 14*a* will continue to supply current to the rails 11 and 12 so that the plasma arc accelerates the projectile 15 along the rails. When the projectile reaches sensor 36*b* (which may be electronic or optical, as desired), the presence of the projectile 15 is sensed and switch 22*b* is closed, enabling maximum desirable current to flow from PESD 14*b* through diode 34*b* to rails 11 and 12. Such current maintains the plasma arc behind the projectile 15 and accelerates it through the next section 10*b* of the railgun. The isolation diode 34*a* of means 35*a* prevents current from PESD 14*b* from propagating back towards the breech end of railgun and recharging the energy source of means 35*a*. As a consequence, the energy from PESD 14*b* is enabled to be used fully for acceleration of the projectile through the second section 10*b* of the railgun.

Sensor 36*b*, switch 22*b*, diode 34*b* and PESD 14*b* thus constitute a means 35*b* for sequentially energizing the second section 10*b* of the railgun. Similar means 35*c*, 35*d*–35*n* are provided to sequentially energize and reapply maximum desired current to successive sections 10*c*, 10*d*–10*n* of the railgun to maintain the plasma arc behind the projectile and accelerate it along rails 11 and 12. Again the isolation diodes, e.g. 34*a*, 34*b*, etc., prevent recharging, and loss of energy from an energized stage to the energy sources of preceding stages.

The energy loss in each stage from resistive heating of the rails is quite small, since the length of the current path through the rail sections is only from the points, i.e. 41 and 42, where the energy sources are connected to the rails to the plasma arc between the rails.

When the projectile 15 exits the discharge end 32 of the railgun, crowbar switch 33 closes, connecting a discharged recovery capacitor 37 across rails 11 and 12. The plasma arc is thereby extinguished, and the remaining inductive voltage in the rails, together with remaining energy from the PESDs of the various stages, causing capacitor 37 to charge. Diode 38 maintains the charge on capacitor 37 and the recovered energy therein can be taken off of terminals 39 and 40 to partially recharge the PESDs, i.e., 14*a*,14*b*, etc., for the next launch.

Figure 5:
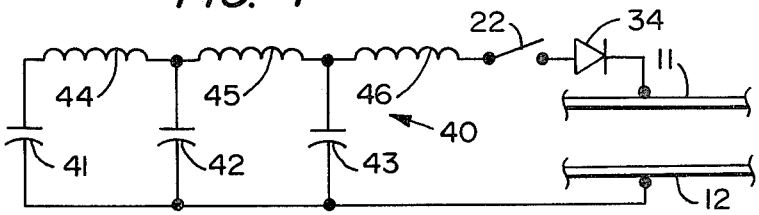
FIG. 5 illustrates an alternate form of a PESD usable in the present invention.

FIG. 5 illustrates an alternate form of a PESD 14 which may be used in the present invention, and in which a capacitor-inductor network 40, made up of capacitors 41,42 and 43 and inductors 44,45 and 46, functions to deliver a shaped pulse, or square wave, of current through diode 34 to rails 11 and 12 when switch 22 is closed. The values of the capacitors and inductors should be chosen so that the pulse length of the current which is applied to the rail gun stage is equal to the transit time of the projectile through that stage. Saturable reactors or Bluemline cables can also be used to apply current to a stage at essentially a constant value for the time needed for the projectile to be accelerated through that stage.

Figures 6, 7:
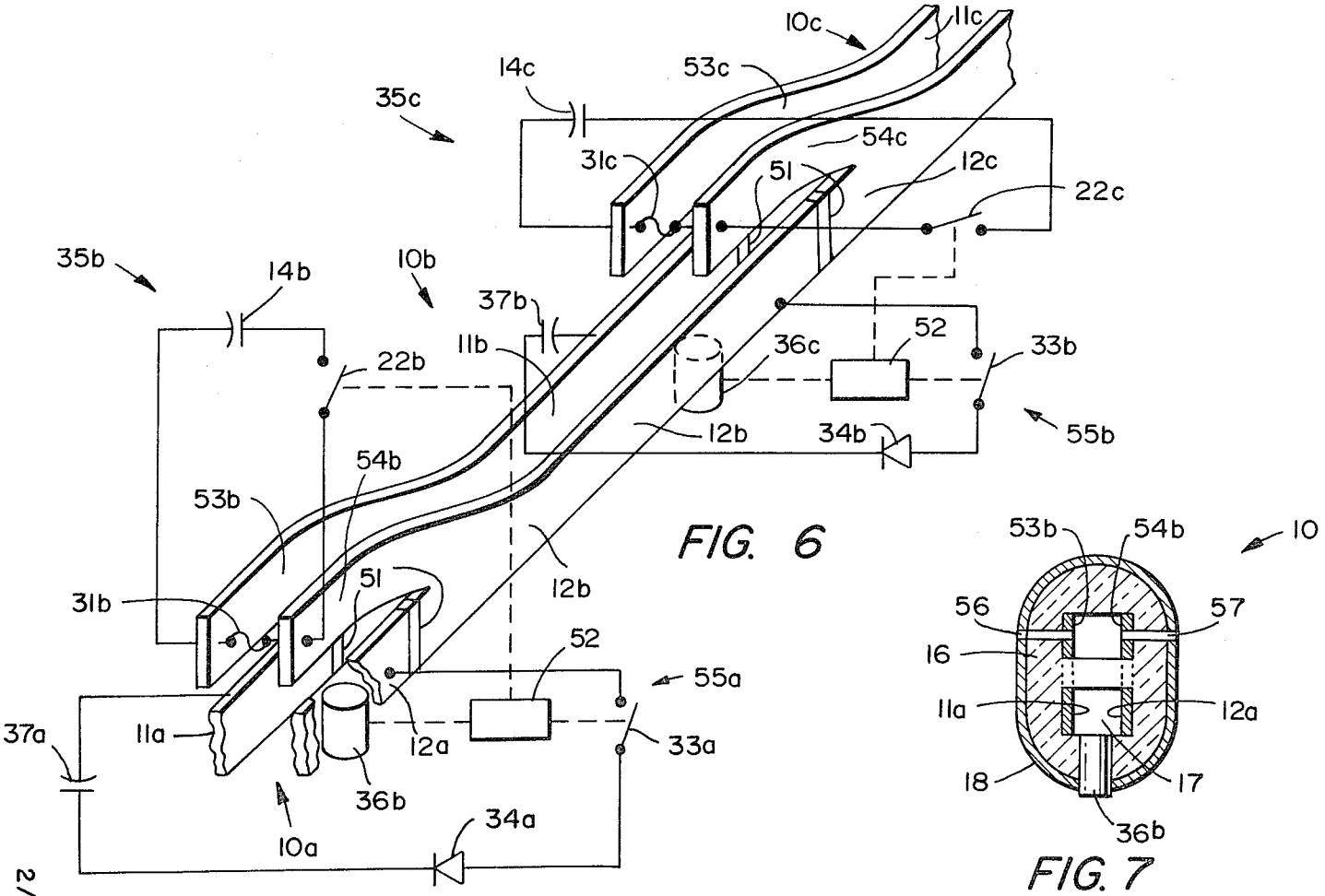
FIG. 6 is a perspective and diagrammatic view of three stages of a multi-stage railgun system in accordance with the present invention, using a side track system of reinitiating the plasma arc in each stage of the railgun.
FIG. 7 is a cross-sectional view of a railgun assembly utilizing the side track system of FIG. 6.

FIG. 6 illustrates a side track method of sequentially energizing successive stage of a multi-stage railgun. In this system, the successive stages are electrically isolated from each other, with rails 11 and 12 each being short sections 11*a*,11*b*,11*c*, etc. and 12*a*,12*b*, 12*c*, etc, which are separated from each other by suitable dielectric spacers 51. In this approach, the plasma arc is extinguished at the end of each stage and restruck at the beginning of the next, with the dielectric isolation of the stages serving to prevent energy from traveling from an energized stage back toward the breech of the railgun.

As the projectile is accelerated down railgun stages 10*a* by the plasma arc between rail sections 11*a* and 12*a* and behind the projectile, the projectile will pass sensor 36*b* which is used to sense the projectile's position and velocity. The signal from sensor 36*b* is applied to timing device 52 which first functions to close switch 33*a* and thereby connect the discharged recovery capacitor 37*a* to rail sections 11*a* and 12*a* when the plasma arc reaches the end of railgun stage 10*a*. The current flow through diode 34*a* to the capacitor 37*a* will cause the plasma arc to extinguish, and the capacitor 37*a* will charge to recover the remaining inductive energy in the railgun stage 10*a*.

After the plasma arc in railgun stage 10*a* is extinguished, timing device 52 will close switch 22*b* to connect PESD 14*b* to side tracks 53*b* to 54*b* (these being offset from and electrically continuous with rail sections 11*a* and 12*a*, respectively), to cause fuse 31*b*, connected between the rails, to establish a plasma arc between the side tracks 53*b* and 54*b*. The arc will accelerate down the side tracks 53*b* and 54*b* in time to arrive behind the projectile as the latter passes the "Y" junction of the side tracks and the rails 11 and 12. Such arc will then accelerate the projectile through the remaining length of the railgun stage 10*b*.

When the projectile reaches sensor 36*c*, timing device 52 associated therewith will close switch 33*b* to extinguish the arc and enable remaining energy in railgun stage 10*b* to be recovered by capacitor 37*b*, and will close switch 22*c* to connect PESD 14*c* to side tracks 53*c* and 54*c* of the next railgun stage 10*c*, so that a new plasma arc is initiated by the vaporization of fuse 31*c*.

With the plasma arc being extinguished at the end of each stage, the arc cannot jump the gap between stages and will not short between successive rail sections, e.g. 11*a* and 11*b*. The switch 33*a* which is used to short rail sections 11*a* and 12*a* to extinguish the arc in stage 10*a* and the spacers 51 between the rail sections 11*a* and 12*a* of the railgun stage 10*a* and the rail sections 11*b* and 12*b* of the next railgun stage 10*b* thus constitute a means 55*a* for preventing propagation of energy from railgun stage 10*b*, when energized, back toward the breech end of the railgun.

FIG. 7 illustrates a cross-section of a side track railgun system as in FIG. 6. Passages 56 and 57 are provided through the jacket 18, dielectric 16 and side tracks 53*b* and 54*b* to enable a new fuse 31*b* to be inserted for the next launch.

Figure 8:
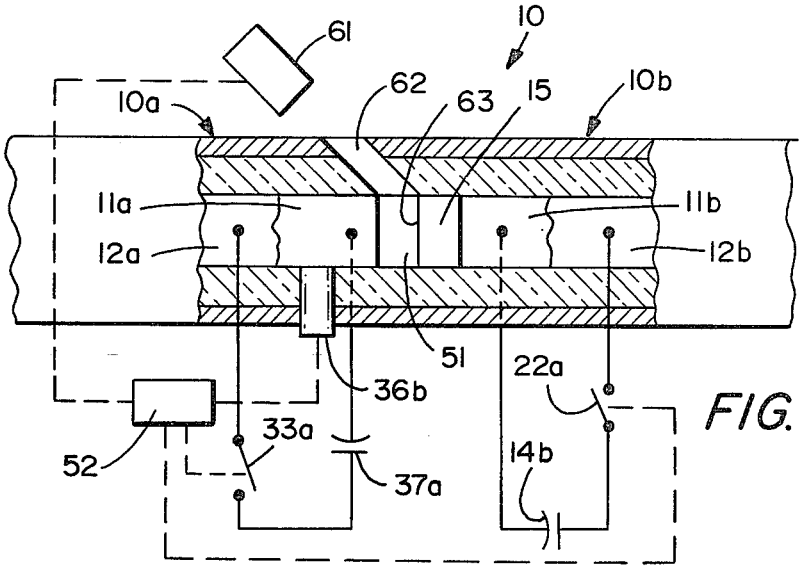
FIG. 8 is a view, partly in section, of two stages of a multi-stage railgun system in accordance with the present invention, using a pulsed laser system of reinitiating the plasma arc in the railgun stages.

FIG. 8 illustrates another form of a railgun 10 wherein the successive stages are electrically isolated from each other, e.g. with dielectric spacers 51 separating the ends of the sections of rails 11 and 12. As with the side track system of FIGS. 6 and 7, sensor 36*b* will sense the passage of projectile 15 therepast, and timing device 52 will close switch 33*a* so that the arc is extinguished at the end of railgun stage 10*a*, and will close switch 22*a* to connect PESD 14*b* to the rail sections 11*b* and 12*b* of the next railgun stage 10*b*. Timing device 52 will also actuate laser device 61 which projects a pulsed laser beam through passage 62 in the railgun into the railgun bore 17 in the vicinity of the rail sections 11*b* and 12*b* to impinge upon the backside 63 of the moving projectile 15. The backside 63 of projectile 15 is provided with a suitable semiconductor coating so that when the rail sections 11*b* and 12 are energized and as the laser beam sweeps across the backside of the projectile, the system will function as a laser activated switch, with the photons freeing enough electrons in the coating to reinitiate the arc between the rail sections 11*b* and 12*b*. With a plasma arc thus reestablished, the arc will accelerate the projectile down the railgun stage 10*b*. At the end of the stage, the arc will be extinguished and a new arc similarly restuck in the next railgun stage.

FIGS. 9–13 are applicable to the various forms of railgun described above.

Figure 9:
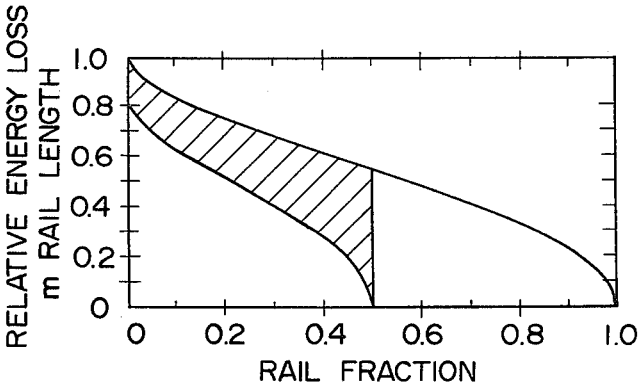

FIG. 9 shows the relative energy loss distributed in the rails 11 and 12 behind the projectile when the projectile has traveled either half or all of the length of the rails. If, at the time the projectile has traveled halfway, the last half of the rail is energized and the previous half is decoupled, the energy represented by the shaded area would not be needed. The energy savings is about 25% for two stages as compared to one.

Figure 10:
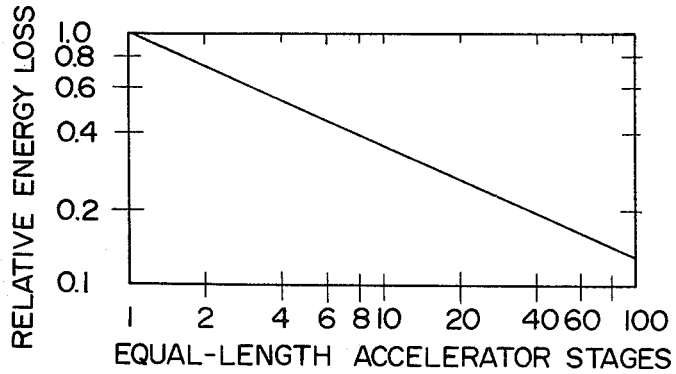

FIG. 10 plots the relative energy loss versus the number of stages. An accelerator comprising 100 equal-length stages would expend only 12% of the energy that would be spent in heating the rails of a single-stage accelerator. (The total energy loss in the rails is approximately proportional to $1/\sqrt{N}$, where N is the number of stages.)

The combined effect of energy savings and operation at near maximum current throughout acceleration is seen in FIG. 11 which shows the required energy, $E_{rq}$, versus velocity for 1-, 10- and 100-stage accelerators. The required energy, $E_{rq}$, is the sum of the kinetic energy, $E_R$, of the projectile, the stored inductive energy, $E_I$, of the rails and the lost energy, $E_L$. An accelerator using 100 stages requires little more energy than a lossless accelerator. Furthermore, most of the energy remaining in the rails could be recovered. In that case, the energy expended would diminish toward the sum of the kinetic energy and lost energy.

Since a multi-stage railgun will experience a lower resistive voltage drop than a single stage railgun, a smaller bore can be used without spurious voltage breakdown, with consequent smaller sabot mass and resulting higher velocity. However, for comparison, a 10 mm bore is used herein for comparison with a single stage railgun.

FIG. 12 shows the transit time, energy loss and energy required in each stage of a railgun with equal length stages (2 m per stage), and the projectile velocity along the length of the railgun, the railgun having the parameters discussed in connection with the previously described single-stage railgun, with the initial current of each stage equal to 75 k A, and the railgun being designed to achieve a launch velocity of 200 km/s.

As will be noted from FIG. 12, the required energy from the PSEDs for each stage ranges from 670 to 530 kJ, with a total energy requirement from the 100 PSEDs of about 57 MJ for a 200 km/s launch. By comparison, about 100 MJ from a single PSED would be required for a single-stage railgun accelerator to achieve a 200 km/s launch.

As another comparison, it has been mentioned above that a single-stage railgun would require about 60 MJ to produce a projectile velocity of 150 km/s. From FIG. 12, such velocity would be achieved at the end of about 60 stages of a 100-stage accelerator with about 32 MJ of energy being required up to that point.

FIG. 13 likewise shows energy required, energy loss, stage length and velocity for a 100-stage, equal transit-time, multi-stage railgun accelerator, with the same parameters as above. The length of each stage ranges from 0.02 to 4.2 km. The required energy of the stages ranges from 5 to 1130 kJ, with a total energy requirement again of about 57 MJ for a 200 km/s launch. From FIG. 13 it is seen that the projectile velocity is 150 km/s after about 72 stages.

A design close to the equal-length stage appears to be most practical. A design based on equal required energy for each stage would be similar to the equal-length design.

In the examples set forth above, the payload mass (0.1 g) is small compared to the sabot mass (1.13 g), and hence the conversion efficiency of the initial energy into payload kinetic energy is small.

If the sabot mass could be used for ignition of fusion, or if the payload mass could be increased without increasing the projectile mass then the efficiency can be significantly increased. Likewise, recovery of the remaining inductive energy can increase efficiency. The table below summarizes efficiences of converting initial stored energy into payload kinetic energy for single-and multi-stage railgun accelerators, wherein sabot mass is 1.13 g and launch velocity is 200 km/s.

| | Without inductive energy recovery (%) | With inductive energy recovery (%) |
|---|---|---|
| Single-Stage Accelerator | | |
| 0.1 g payload | 1.8 | 2.16 |
| 1.0 g payload | 9.5 | 11.3 |
| 1.13 g sabot as payload | 22 | 26.6 |
| 100-Stage Accelerator | | |
| 0.1 g payload | 3.5 | 6 |
| 1.0 g payload | 19 | 33 |
| 1.13 g sabot as payload | 44 | 78 |

Thus for the same results desired, and with the same design parameters, the efficiency of a 100-stage railgun is approximately 3 times that of a single-stage railgun.

INDUSTRIAL APPLICABILITY

As mentioned previously, projectiles accelerated to hypervelocities (150 l km/s) could be used to initial thermonuclear fusion.

The spectrum of other applications of an accelerator capable of delivering intact projectiles at velocities greater than 10 km/s is very wide. For example, research and technical development may lead to low-cost orbital launching. Equation-of-state research will advance immediately as the payload is delivered at velocities greater than those attained with two-stage gas guns (7 to 10 km/s) and high-explosive techniques (6 to 7 km/s). Impact pressures of 1 to 10 TPa in medium- and high-Z materials will be possible with velocities in the range of 7 to 35 km/s. Magnetic-field compression to presently unattained intensities will require velocities greater than 20 km/s. Hybrid compression techniques such as magnetic compression followed by impact compression will be especially useful for compressing low-Z materials. At very high velocities (>200 km/s) high-energy density research will be possible.

We claim:

1. A multiple stage magnetic railgun (10) having breech and discharge ends (29,32), comprising:

a pair of electrically conductive rails (11,12) extending between said breech and discharge ends (29,32), said rails (11,12) being spaced apart to define a bore (17) therebetween, said pair of rails (11,12) being divided into a plurality of successive rail stages (10*a–n*) along the length of said railgun (10), energizing means (35*a–n*) for electrically energizing each successive rail stages (10*a–n*) in sequence to accelerate an arc (13) through the energized stage and in a direction toward the discharge end (32) of said railgun (10), and means (34*a–n*, 55*a–n*) for preventing propagation of energy from an energized stage (10*b–n*) back towards the breech end (29) of said railgun (10).

2. A multiple stage magnetic railgun (10) in accordance with claim 1 and wherein said energizing means (35*a–n*) includes means (36*b–n*) for sensing movement of a projectile (15) along said bore (17) for actuating said energizing means (35*a–n*).

3. A multiple stage magnetic railgun (10) in accordance with claim 1, and including a diode (34*a–n*) for each stage (10*a–n*) and wherein said energizing means (35*a–n*) includes a primary energy-storing device (14*a–n*) for each stage, a sensor means (36*b–n*) associated with each stage for sensing movement of a projectile (15) through said bore (17) and means (22*a–n*) for connecting the primary energy-storing device (14*a–n*) of a stage to the rails (11,12) of that stage through the diode (34*a–n*) of that stage in response to sensing of projectile movement by the sensor means (36*a–n*) associated with that stage.

4. A multiple stage magnetic railgun (10) in accordance with claim 3, wherein each of said rails (11,12) is electrically continuous along the length thereof.

5. A multiple stage railgun (10) in accordance with claim 3, and further including means (33,37) for shorting said rails (11,12) together and for recovering inductive energy from said rails (11,12) when a projectile (15) exits from said discharge end 32 of said railgun (10).

6. A multiple stage magnetic railgun (10) in accordance with claim 1 wherein said railgun (10) has at least two successive rail stages (10*a*,10*b*), wherein said first rail (11) has a rail section (11*a*) in the first rail stage (10*a*) and a rail section (11*b*) in the second rail stage (10*b*), the two rail sections (11*a*,11*b*) of said first rail (11) being electrically isolated from each other, wherein said second rail (12) has a rail section (12*a*) in the first rail stage (10*a*) and a rail section (12*b*) in the second rail stage (10*b*), the two rail sections (12*a*,12*b*) of said second rail (12) being electrically isolated from each other, and further including:

means (33*a*) for extinguishing an arc between the rail sections (11*a*,12*a*) of the first rail stage (10*a*) prior to energization of the second rail stage (10*b*), arc initiating means (31*b*,61) for initiating an arc between the rail sections (11*b*,12*b*) of the second rail stage (10*b*) when said second rail stage (10*b*) is energized.

7. A multiple stage magnetic railgun (10) in accordance with claim 6 and further including means (37*a*) for recovering inductive energy in said first rail stage after extinction of an arc between the rail sections (11*a*,12*a*) of said first rail stage (10*a*).

8. A multiple stage magnetic railgun (10) in accordance with claim 6, wherein each of said rail sections (11*b*,12*b*) of said second rail stage (10*b*) has an electrically conductive side track (53*b*,54*b*) offset therefrom and electrically continuous therewith, the two side tracks (53*b*,54*b*) being parallel to each other, and wherein said arc initiating means (31*b*) comprises a fusible wire (31*b*) connected between said side tracks.

9. A multiple stage magnetic railgun (10) in accordance with claim 6, wherein said arc initiating means (161) includes laser means (61) for directing a laser beam into said railgun bore (17) in the vicinity of said rail sections (11*b*,12*b*) of said second rail stage (10*b*).

* * * * *